US007926849B2

(12) United States Patent
Lenhart

(10) Patent No.: US 7,926,849 B2
(45) Date of Patent: Apr. 19, 2011

(54) SKI POLE BASKET COMPRISING AN ADJUSTABLE SUPPORTING SURFACE

(75) Inventor: Klaus Lenhart, Ohmden (DE)

(73) Assignee: Lekisport AG, Baar (CH)

( * ) Notice: Subject to any disclaimer, the term of this patent is extended or adjusted under 35 U.S.C. 154(b) by 213 days.

(21) Appl. No.: 12/306,776

(22) PCT Filed: Jun. 29, 2007

(86) PCT No.: PCT/CH2007/000320

§ 371 (c)(1),
(2), (4) Date: Dec. 29, 2008

(87) PCT Pub. No.: WO2008/000109

PCT Pub. Date: Jan. 3, 2008

(65) Prior Publication Data

US 2009/0194986 A1 Aug. 6, 2009

(30) Foreign Application Priority Data

Jun. 30, 2006 (CH) ..... 1059/06

(51) Int. Cl.
*A63C 11/24* (2006.01)

(52) U.S. Cl. ..... 280/824; 280/819

(58) Field of Classification Search ..... 280/812, 280/813, 819, 823, 824; 36/122, 123, 124, 36/125

See application file for complete search history.

(56) References Cited

U.S. PATENT DOCUMENTS

| | | | | |
|---|---|---|---|---|
| 3,645,553 | A | 2/1972 | Hinterholzer | |
| 4,221,392 | A * | 9/1980 | Aho | 280/824 |
| 4,921,275 | A * | 5/1990 | Santanen et al. | 280/824 |
| 4,955,969 | A * | 9/1990 | Jansson et al. | 280/824 |
| 5,290,064 | A * | 3/1994 | Leon et al. | 280/824 |

FOREIGN PATENT DOCUMENTS

| | | | |
|---|---|---|---|
| DE | 14 78 108 | A1 | 8/1969 |
| DE | 20 27 461 | A1 | 12/1971 |
| DE | 29 52 149 | A1 | 7/1981 |
| EP | 0 035 200 | A1 | 9/1981 |
| FR | 1 439 543 | A | 5/1966 |
| FR | 2 249 686 | A1 | 5/1975 |

* cited by examiner

*Primary Examiner* — J. Allen Shriver, II
*Assistant Examiner* — John D. Walters
(74) *Attorney, Agent, or Firm* — Sughrue Mion, PLLC

(57) ABSTRACT

The invention relates to an attachment for a ski pole, especially for downhill or cross-country skiing, comprising a tip attachment (3) that is provided with an upward-facing receiving area (4) for a pole tube (1), a downward-facing pole tip (7, 8), and a rigid basket area (5) which essentially extends on a plane that runs perpendicular or at a 60° to 120° angle to the axis of the pole tube (1). In order to be able to easily adjust the ski pole to different snow conditions, a basket plate (9) is disposed in the basket area (5) in such a way that said basket plate (9) can be fastened in a first position (15) and in at least one second position (16) in which the basket plate (9) is displaced relative to the first position substantially along the plane of the basket area (5), the supporting surface that is effective on the ground being larger in the second position (16) than in the first position (15).

25 Claims, 8 Drawing Sheets

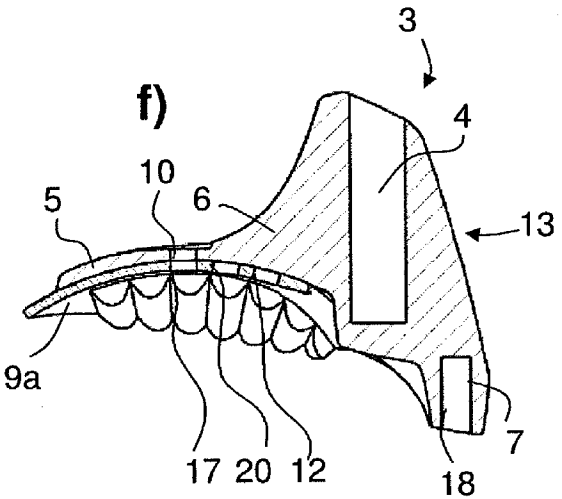
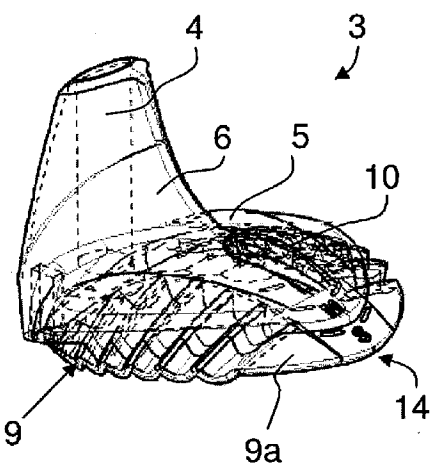
Fig. 3
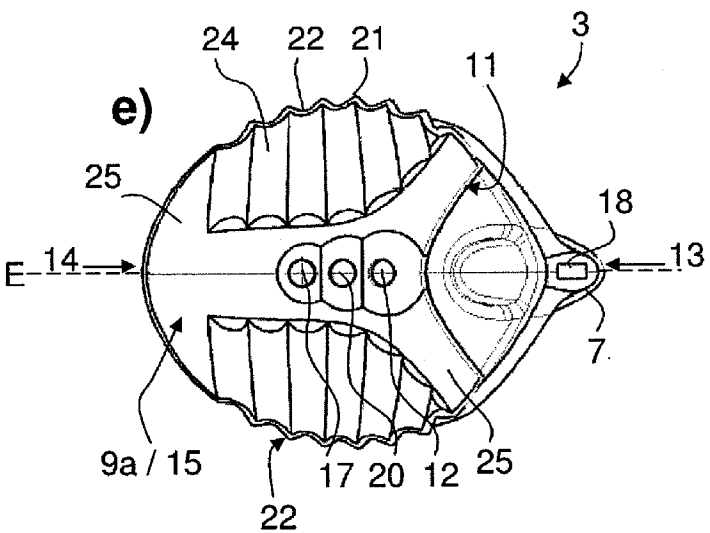
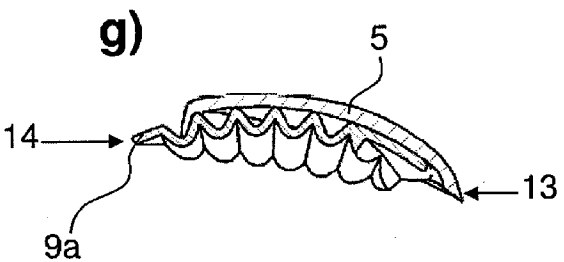

SKI POLE BASKET COMPRISING AN ADJUSTABLE SUPPORTING SURFACE

TECHNICAL FIELD

The invention relates to an attachment for a ski pole, in particular for downhill or cross-country skiing, having a tip attachment which has an upwardly directed accommodating region for a pole shaft, as well as a downwardly directed pole tip and a stiff basket region which extends essentially along a plane perpendicular, or at an angle of between 60-120°, to the axis of the pole shaft.

PRIOR ART

In downhill skiing and also in cross-country skiing, use is made of poles in order, on the one hand, to provide lateral support on the ground and, on the other hand, to initiate forward movement. For this purpose, the poles have a handle, an actual shaft and a tip, this tip additionally having a basket. The tip is provided for penetrating into the underlying surface, for example, snow or ice, and the basket serves to limit this penetration, by the basket providing a large bearing surface area for bearing on the underlying surface.

Such baskets may be in different forms; the classic form here comprises, for example, a ring which is connected to the pole via connecting elements. It is likewise known for the pole tip to be designed such that it is possible to fasten different baskets of different sizes, colors, etc.

In particular at the elite end, for example, of cross-country skiing, for instance for so-called skating, it is critical to have precisely the correct size of basket available. This size depends, inter alia, on the nature of the underlying surface from which the pole is used for pushing off. If the snow, for example, is soft, then a comparatively large bearing surface area is necessary; however, if the snow is hard and, for example, frozen, then the smallest basket surface area possible could well be desired in order to reduce weight and also to prevent sticking in the snow.

Accordingly, there is a need for variably adjustable pole tips and/or in particular for the associated basket regions to be variably adjustable, wherein this variability is to be provided, as far as possible, without high outlay being involved, a straightforward changeover between different sizes is possible and, nevertheless, optimum shaping of the basket is provided.

U.S. Pat. No. 4,921,275, for example, discloses designs in which the basket can be swung round, that is to say there is a first position, in which the basket is active and prevents the pole from sinking into soft material, and a second, swung-up or collapsed position, in which the pole basket essentially does not perform any function.

Also known are designs (see, for example, FR 2 249 686, DE 20 27 461, DE 29 52 149 or U.S. Pat. No. 3,645,553) in which the basket can be swung open virtually like an umbrella for a supporting position and can be collapsed for a retracted position.

DESCRIPTION OF THE INVENTION

Accordingly, the invention is based, inter alia, on the object of providing such an improved design.

In particular the aim is to improve an attachment for a pole, e.g. for downhill or cross-country skiing (e.g. Nordic skiing or skating), but also for hiking poles or Nordic walking poles, having a tip attachment which preferably has an upwardly directed accommodating region for a pole shaft, as well as a downwardly directed pole tip and a stiff basket region which extends essentially along a plane perpendicular, or at an angle of between 60-120°, to the axis of the pole shaft.

Such attachments are produced for example from (hard) plastics material by injection molding. It is normally the case, as has been said, that the plane of the basket is essentially perpendicular to the direction of the pole shaft, but it is also possible to provide, if appropriate, a slight inclination, in particular such that the plane of the basket is tilted about an axis perpendicular to the direction of travel and perpendicular to the pole shaft, for example by being drawn slightly upward to the rear. Such inclination, however, is normally only slight, and the deviation from the position perpendicular to the shaft is normally less than 30°, preferably less than 10 or 15°.

This object is achieved in that a separate and additional basket plate is arranged on the basket region such that it can be fastened both in a first position and in at least a second position, which is displaced essentially along the plane of the basket region in relation to the first position, the bearing surface area which is active on the underlying surface being larger in the second position than in the first position. A larger bearing surface area here is to be understood in the sense that the basket plate projects beyond the basket region preferably at least over a circumferential region of the basket of 90°, in particular preferably of at least 180°, and this circumferential region is also enlarged by virtue of the basket plate being displaced. The displacement also means that enlargement takes place preferably asymmetrically, that is to say displacement of the basket plate enlarges the basket essentially in one direction. It is typically the side which is directed to the rear, as seen in relation to the direction of travel, which is enlarged.

The core of the invention thus consists in rendering the design, virtually in two parts, wherein a first part, the basket region, is of rigid design and virtually provides for the stiffness. A second part, the basket plate, then, can be fastened on this basket region so as to make possible at least the above-mentioned two or more positions with different bearing surface areas. With a first position and a second position, this second position provides a larger bearing surface area for the basket. This ensures a design in which variability is possible without any additional components having to be carried along by the user. In addition, this two-part design gives rise to optimum stability and a straightforward, robust construction.

According to a first preferred embodiment of the invention, the attachment is characterized in that the basket plate is arranged on the underside of the basket region. Therefore, all that is necessary, in essence, is for the basket plate to be fixed on the basket region from beneath, and the basket region located thereabove stabilizes the basket plate. Accordingly, the basket plate itself, rather than having to be completely stiff, may consist of a partially flexible material. As an alternative to this, however, it is also possible for the basket plate to consist of a flexurally rigid material, e.g. hard plastics material.

A particularly preferred embodiment of the attachment is characterized in that the basket region has concave curvature on its underside, and in that the basket plate is fastened in this curvature from beneath such that the inherently planar basket plate essentially continues, or assumes, the curved shape of the basket region, at least in part, in at least one of the two positions, preferably in both positions. Furthermore, this design gives rise to the basket plate being curved as it is fastened on the underside, which, on the one hand, makes it possible for the basket plate to be inherently planar and for the definitive shaping to be produced virtually by attachment to the basket region and, furthermore, the curvature of the basket plate following the fastening gives rise to stabilization. Following the fastening, as a result of the curvature, the basket plate is able to deform to a significantly lesser extent under loading.

Such baskets formed concavely or, as it were, with a depression on the underside are known, in particular, in cross-country skiing. Typically, they are additionally of asymmetrical design, that is to say the basket extends rearwards virtually essentially only in the direction of travel. The curved shape of the basket gives rise to optimum behavior in the underlying surface when the pole is introduced obliquely into the underlying surface for pushing-off purposes.

This embodiment is advantageous since it is possible to provide a cost-effective basket plate made of an inherently planar material. For example, it is possible to produce (cut, punch) the basket plate from a flat plastics-material panel of a few millimeters in thickness, and the actual optimum 3-dimensional shaping is then predetermined only by virtue of the basket plate being fastened on the basket region from beneath. In order to ensure this adaptation to the shape of the basket region, the fastening means, rather than being arranged on the edge of the basket region, are preferably arranged in the central region, i.e. the region which is slightly offset depthwise, in order that the basket plate effectively assumes the curvature of the basket region.

As has already been mentioned, the basket region is preferably of asymmetrical design. In this case it essentially does not project in particular toward the front side and the main extent of the basket region is directed toward the rear side. The basket region in particular preferably is of circular, elliptical or approximately lenticular design.

It is possible for the basket plate to consist of a stiff material and to have its own three-dimensional shape from the outset. For example, the basket plate may be formed from an essentially flexurally rigid material, e.g. hard plastics material, and therefore be essentially stiff and/or hard. It is possible here for the basket plate to consist of the same material as the basket region, wherein it is preferred if the basket plate has essentially the same curvature as the basket region. However, as has already been mentioned, it may preferably consist simply of a planar plate which is possibly flexible, in which case its shape on the pole is predetermined by being fastened on the basket region. The basket plate preferably has a cutout which is open, in particular preferably, on one side and is intended for the pole tip and/or an extension which carries the pole tip. This cutout may be, for example, a U-shaped or V-shaped cutout. The basket plate may consist of a plastics material, preferably of PE, PET, PP, PU, PA or other thermoplastics or mixtures thereof, in particular preferably having a thickness ranging from 0.1-0.4 cm.

According to a further preferred embodiment of the invention, the basket region preferably has at least one hole, but preferably two or more holes, in a region which is offset to the rear in relation to the pole shaft, wherein the basket plate has at least one front hole, but preferably a pair of front holes, and at least one rear hole, but preferably a pair of rear holes, and wherein fastening means, in particular preferably in the form of screws (or also rivets, staples, pins, etc.), are provided to engage through these holes and to fasten the basket plate on the basket region. Of course, the converse situation is also possible, that is to say the situation where the basket plate has only one pair of holes and the basket region has at least two pairs of holes arranged one behind the other.

The preferred version, however, is that in which the basket plate has a number of pairs (also more than two pairs are possible for a multiplicity of different positions) of holes since, in this case, the basket region is not weakened by holes and, in addition, in the case of a basket plate being fastened from beneath, the holes which are not being used are not visible from above.

According to an alternative embodiment, the basket region has just one hole, which is preferably arranged in the center. Additionally, the basket plate and/or the basket region preferably have/has at least one means for preventing rotation of the basket plate on the basket region. The number of holes in the basket plate advantageously corresponds to the number of adjusting positions of the basket plate on the basket region. The at least one means for preventing rotation of the basket plate on the basket region may be, for example, a ribbed region or a toothing formation, wherein preferably the ribbing or toothing formation in the basket plate advantageously engages in a corresponding ribbing or toothing formation in the basket region. The ribbing or toothing formation here may be provided in a downwardly directed edge of the basket region which runs all the way round the rear region. In addition to stabilization and prevention of rotation, such a ribbing formation has the further advantage that the pole basket provides a better hold or grip in the snow or in other soft underlying surfaces. This alternative embodiment is preferably a hard and/or stiff or essentially flexurally rigid basket plate.

Moreover, other mechanisms are also conceivable in principle, for example a rail which runs in the direction of travel and integrally formed and/or provided, for example, on the underside of the basket region, the basket plate being guided in this rail via a complementary rail. Via a snap-in mechanism or the like, for example, it is then possible to reach and secure the individual positions of the basket plate by, for example, a locking tongue being pushed down and, as a result, the basket plate can be displaced over the rail to a further latching position. Also possible is stepless adjustability, in which case the positions can be secured via a force fit (e.g. clamping).

In the case of the abovementioned holes, it has proven to be advantageous if there is a pair of holes in each case (no rotation of the basket plate). It is also possible to use a central screw with a rotation-prevention means, which may be configured, for example, in the form of a guide rail, groove/tongue, protuberances/recesses, etc. It is further preferable if the screws are screws in which the one, first screw has an internal thread in the screw shank and a second screw has a corresponding external thread on the screw shank, these threads engaging one inside the other in the hole(s). It is possible here for the first screw to be mounted in a rotationally fixed manner in the basket region. Rotation can also be prevented, however, by alternative means, for example a ribbing or toothing formation in the basket plate and/or basket region.

It is preferably possible to fasten basket plates which differ in respect of size, shape, flexibility and/or color.

According to a further preferred embodiment, the basket plate, in the first position, essentially does not project beyond the basket region at the front edge, which is directed toward the front side, and projects beyond the basket region by between 0.2-1.5 cm laterally and/or at the rear edge, which is directed toward the rear side. If the basket plate, in the second position, has been displaced toward the rear side, then it projects beyond the basket region by between 0.5-2.5 cm at the rear edge, which is directed toward the rear side.

As has already been explained, according to a preferred embodiment, the tip attachment consists of hard plastics material (for example PE, PET, PP, PU, PA or other thermoplastics or mixtures thereof) and the tip attachment, in particular preferably on the top side, has at least one essentially vertically running stiffening rib between the basket region and the accommodating region.

The present invention also relates to a method by means of which a ski pole, in particular for downhill or cross-country skiing, having an attachment as has been outlined above is adapted to different conditions in the underlying surface, in particular different snow conditions.

The method is characterized, inter alia, in that, for a comparatively hard underlying surface, the basket plate is arranged in the first position, and in that, for a comparatively soft underlying surface, the basket plate is arranged in the second position.

Further preferred embodiments of the invention are described in the dependent claims.

BRIEF EXPLANATION OF THE FIGURES

The invention will be explained in more detail hereinbelow with reference to exemplary embodiments and in conjunction with the drawings, in which.

WAYS OF IMPLEMENTING THE INVENTION

The invention will now be explained with reference to the figures. The exemplary embodiments given below are to serve merely as an illustration of the invention, but should not be used to limit the actual idea of the invention as defined in the appended claims.

Figure 1:
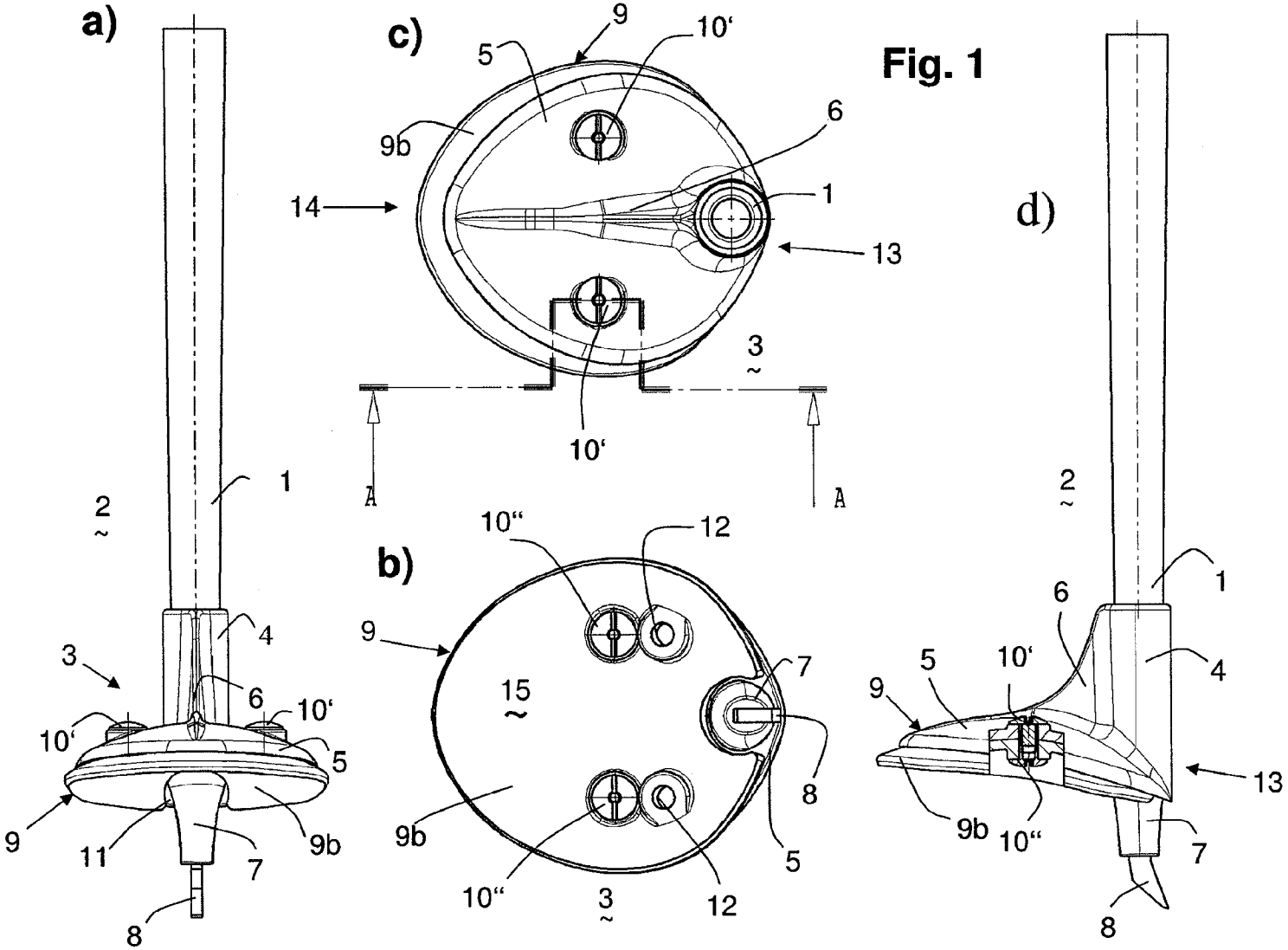
FIG. 1 shows different views of the pole tip according to a first embodiment of the invention for a situation in which the basket plate is mounted in the front position, wherein a) illustrates a view from behind, b) illustrates a view from beneath, c) illustrates a view from above, and d) illustrates a view or a section along line A-A in FIG. 1*c*)

FIG. 1 illustrates different views of the tip of a cross-country-skiing pole according to a first embodiment of the invention. Only the bottom region of the pole is illustrated here; in order to simplify the illustration, the top region of the handle is not visible. FIG. 1*a* illustrates a view from behind, wherein "behind" is intended to mean the side which is directed to the rear in the direction of travel. The pole 2 comprises a pole shaft 1, which is introduced into a tip attachment 3. For this purpose, the pole shaft 1 is screwed, adhesively bonded or pressed into an accommodating region 4. The tip attachment 3 consists, for example, of plastics material and comprises, at one end, the already mentioned, upwardly directed accommodating region 4 and, toward the bottom, an extension 7 for accommodating a pole tip 8. The pole tip 8 is configured as a hardened, preferably asymmetrically formed metal tip (e.g. sintered hard metal) or ceramic tip, which is adhesively bonded, pressed or clamped into this extension 7.

The tip attachment 3 also comprises a basket region 5, which is arranged essentially perpendicularly to the direction of the pole shaft 1. As can be seen, in particular, from FIG. 1*d*, the basket region is of asymmetrical configuration, i.e. this basket region 5 does not project toward the front side 13, whereas it has its maximum extent toward the rear side 14. This can also be seen from the view from beneath (according to FIG. 1*b*) and from the view from above, (according to FIG. 1*c*). In order for the basket region 5, which, as has been said, projects essentially only in the rearward direction, to be supported in particular under sport-induced loading, a stiffening rib 6 is provided in addition, this stiffening rib running essentially vertically and being arranged between the accommodating region 4, designed as a hollow cylinder, and the basket region 5, on the top side of the basket region 5. This tip attachment 3 is preferably formed in one piece, i.e. the accommodating region 4, the basket region 5, the rearwardly directed stiffening rib 6 and the extension 7 are configured as a single molding.

A basket plate 9 which is flexible at least to a certain extent is then fastened on the underside of this molding produced from rigid plastics material (for example an injection molding made of a plastics material such as PE, PET, PP, PU, PA or other thermoplastics or mixtures thereof). FIG. 1 illustrates this basket plate 9 in a first position, in which the basket plate barely projects beyond the outer contour of the basket region 5. This first position is designated 15 and is referred to as the front position. As can be seen, in particular, from FIG. 1*c*, in this position, the basket plate 9 projects beyond the outer contour of the basket region 5 basically not at all toward the front side, but to a slight extent on the side and toward the rear.

In this context, more details should be given for the specific formation of the basket region 5. On its underside, i.e. on the side which is directed toward the pole tip 8, the basket region is configured with inner curvature, that is to say with a hollow-like depression, i.e. it is of three-dimensional conical configuration. This results in optimal engagements in the underlying surface. As can be seen, in addition, from FIG. 1*d*, the plane of the basket region 5, rather than being arranged precisely perpendicularly to the direction of the pole shaft, has been drawn upward slightly to the rear, but this is only optional.

The essential factor with this concave depression in the underside, then, is the fact that it is possible, according to the invention, for the flexible basket plate 9 to be fitted on the basket region 5 from beneath such that the basket region 5 forces the basket plate 9 into this shape and the basket plate 9 continues this shape. This is possible by for example using fastening screws 10 for fastening purposes, as can be seen from FIG. 1*d* which illustrates a section along line A-A in FIG. 1*c*. The fastening screws 10 are arranged symmetrically, on both sides in two holes in the basket region 5. The basket plate 9, for its part, has corresponding holes, to be precise a pair of front holes 12 and a pair of rear holes 17. The screws 10 engage through both the holes in the basket region and either the front holes or the rear holes in the basket plate. The screws 10 here are configured such that, as illustrated by way of example in FIG. 1*d*, the top screw 10' has an internal thread in its screw shank and the bottom screw 10" engages in this internal thread by way of its screw shank, which has an external thread. The situation where one end of the screw projects outward can therefore be avoided. The risk of soiling or contamination is avoided in addition.

As a result of being fastened in the concave region of the underside of the basket region 5 by the screws 10, then, the basket plate 9 is pressed onto the underside of the basket region 5 such that the inherently planar basket plate 9 is deformed and assumes the concave shape of the basket region 5. As an alternative, or in addition, it is also possible, however, for the basket plate 9 to be preformed. In order also to be able to ensure optimum adaptation in the front region, the basket plate 9 has a cutout 11 for the extension 7.

It is thus possible to provide a very straightforward design of such a basket plate 9. The basket plate 9 may be punched or cut, in the form of a plastic-material plate, out of a large panel and needs not initially have any three-dimensional shaping. The three-dimensional shaping is predetermined by the basket plate being fastened on the basket region 5, although it may also be already preformed to a slight extent or be produced by injection molding. The basket plate 9 or 9*b* preferably has sufficient flexibility in order to assume the shape forced upon it as it is fastened on the basket region 5, but it has sufficient inherent stiffness in order that there is no significant deformation in the edge region, in particular in the rear position 16 illustrated in FIG. 2, during use.

As can be seen from FIG. 1*b*, the basket plate 9 in FIG. 1 is illustrated in the front position 15. This means that the basket plate 9 is fastened on the basket region via the two rear holes 17.

Figure 2:
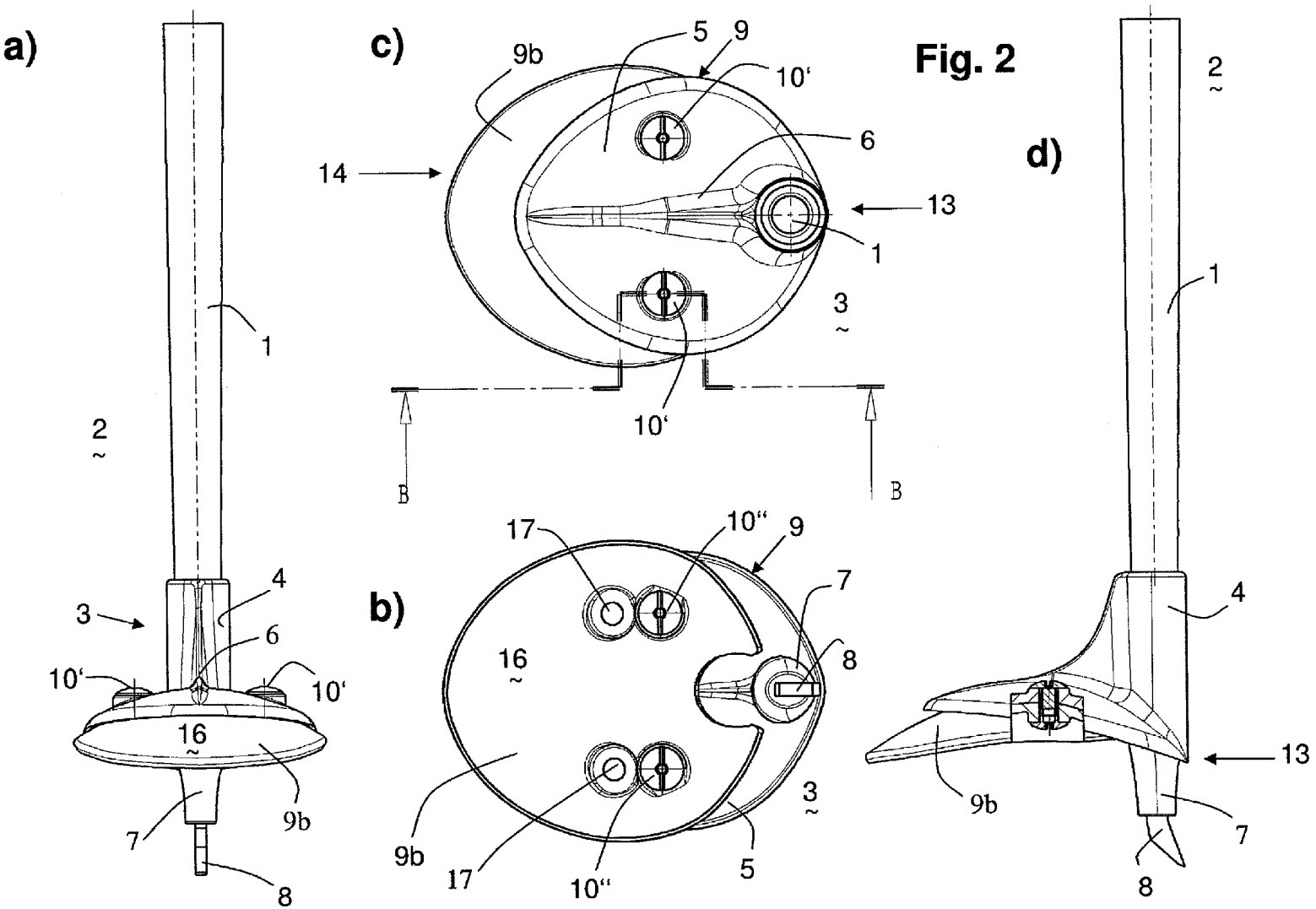
FIG. 2 shows different views of the pole tip according to the embodiment from FIG. 1 for a situation in which the basket plate is mounted in the rear position, wherein a) illustrates a view from behind, b) illustrates a view from beneath, c) illustrates a view from above, and d) illustrates a view or a section along line A-A in FIG. 2*c*)

FIG. 2, then, shows, in corresponding illustrations a-d, the second possible position, in which the basket plate 9 is fastened on the basket region 5 in the rear position 16. For this purpose, the basket plate 9 is fastened on the basket region 5, via the screws 10, by way of the two front holes 12. The basket plate 9 has thus been displaced rearward by approximately 0.5-1.5 cm and now projects significantly beyond the outer contour of the basket region 5, in particular, on the rear side. In this second position 16, a much larger bearing surface area of the basket is therefore available. Nevertheless, as can be seen, in particular, from FIGS. 2*a* and 2*d*, the basket plate 9 is still shaped concavely, this being predetermined by the underside structure of the basket region. In addition, as a result of the rearwardly displaced basket plate, the plane of the basket is displaced essentially into a position perpendicular to the pole shaft, which is very advantageous for soft underlying surfaces. In this rear position, the basket plate 9 projects by approximately 0.5-1.5 cm beyond the outer contour toward the rear side 14. The amount of bearing surface area increases by approximately 10-40%.

Of course, it is also possible for the basket plate 9 to be removed altogether if the underlying surface, for example, is very hard; the weight-induced loading is then minimal.

Such a pole, then, is particularly straightforward to use and/or to change over between the two positions. If the user establishes, either at the start of a competition or midway through skiing, that the conditions of the underlying surface have significantly changed, then, for example if the underlying surface has softened during the course of the day, he can use a straightforward screwdriver, or some other tool appropriate for the screw heads, to loosen the two screws 10, starting from a front position as illustrated in FIG. 1, push the basket plate rearward into the second position and refasten it using the same fastening screws, but now using the front holes, on the tip attachment 3. Optimum adaptation to the conditions can thus be carried out with just a small number of manipulations. In order to simplify matters further, it is also possible to replace the screws, at least on their top side, by small wing nuts or the like, in which case no additional tools are necessary, or, for example, to fasten the tool for changing the two positions directly on the pole, (for example in the handle or on the pole shaft), in order that it is always carried along and the user does not have to search for it. Also possible are so-called pushbuttons, which may be configured entirely from plastics material (e.g. tongues which can be pushed in, spring activation also being possible) and which engage or latch in corresponding recesses, widened portions or widenings in guide means, dovetail guides, toothing formations, etc.

In addition, the proposed design is advantageous insofar as it is also possible for different basket plates of different shapes, sizes, levels of flexibility, colors, etc. to be fastened on this tip attachment 3. For example, it is possible to provide different colors for different sizes, and since the basket plates 9, when not fastened on the underside of the basket region, are simply flat disks, different sizes of the same can easily be carried along. Depending on the conditions, pole baskets of significantly different sizes can then be made available. These can then be fastened in turn, depending on the conditions, in two positions.

Figure 3:
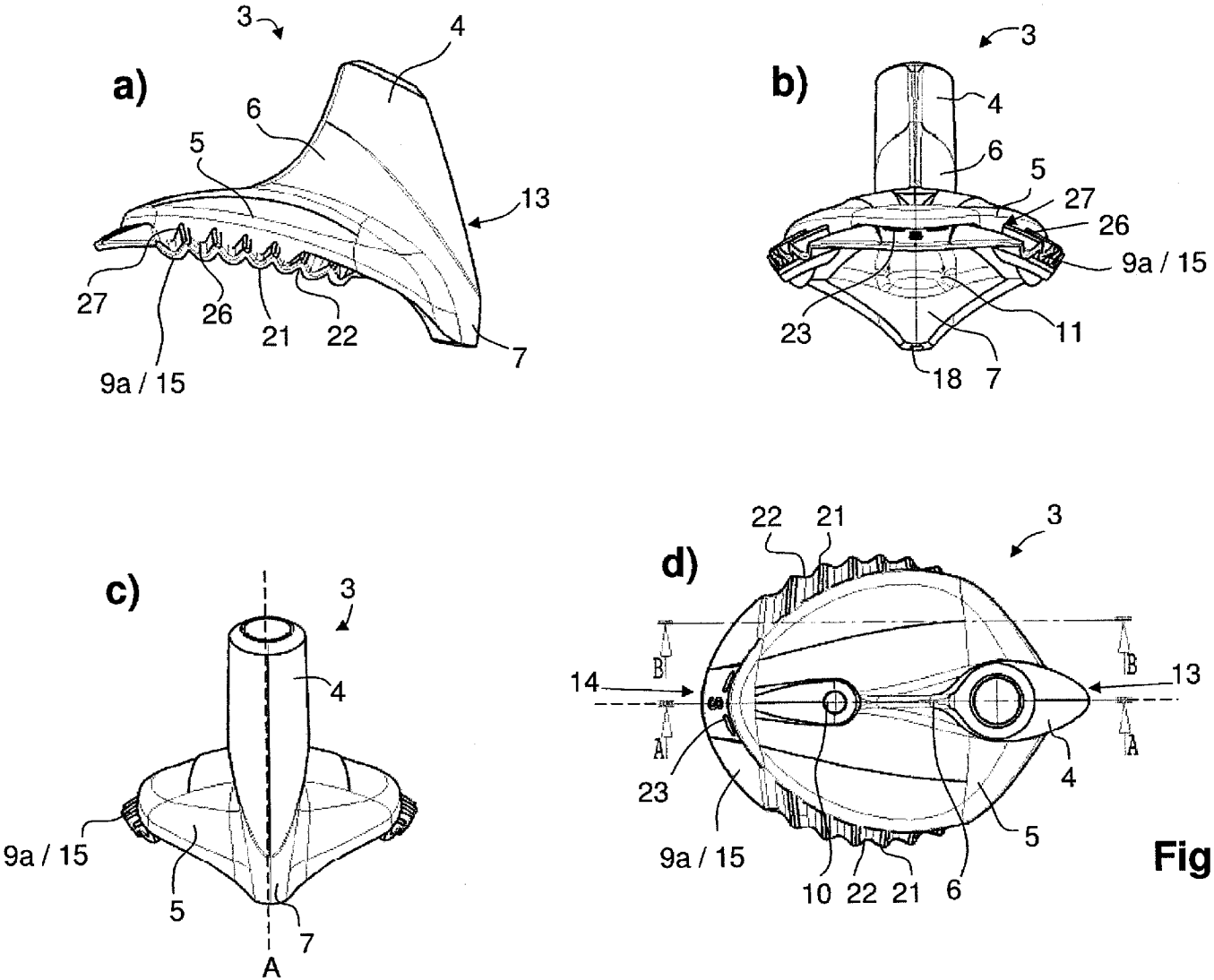
FIG. 3 shows different views of the pole tip according to a second embodiment of the invention for a situation in which the basket plate is mounted in the foremost of three possible positions, wherein a) illustrates a view from the side, b) illustrates a view from behind, c) illustrates a view from the front, d) illustrates a view from above, e) illustrates a view from beneath, f) illustrates a section along line A-A, g) illustrates a section along line B-B, and h) illustrates a three-dimensional view.
Figure 4:
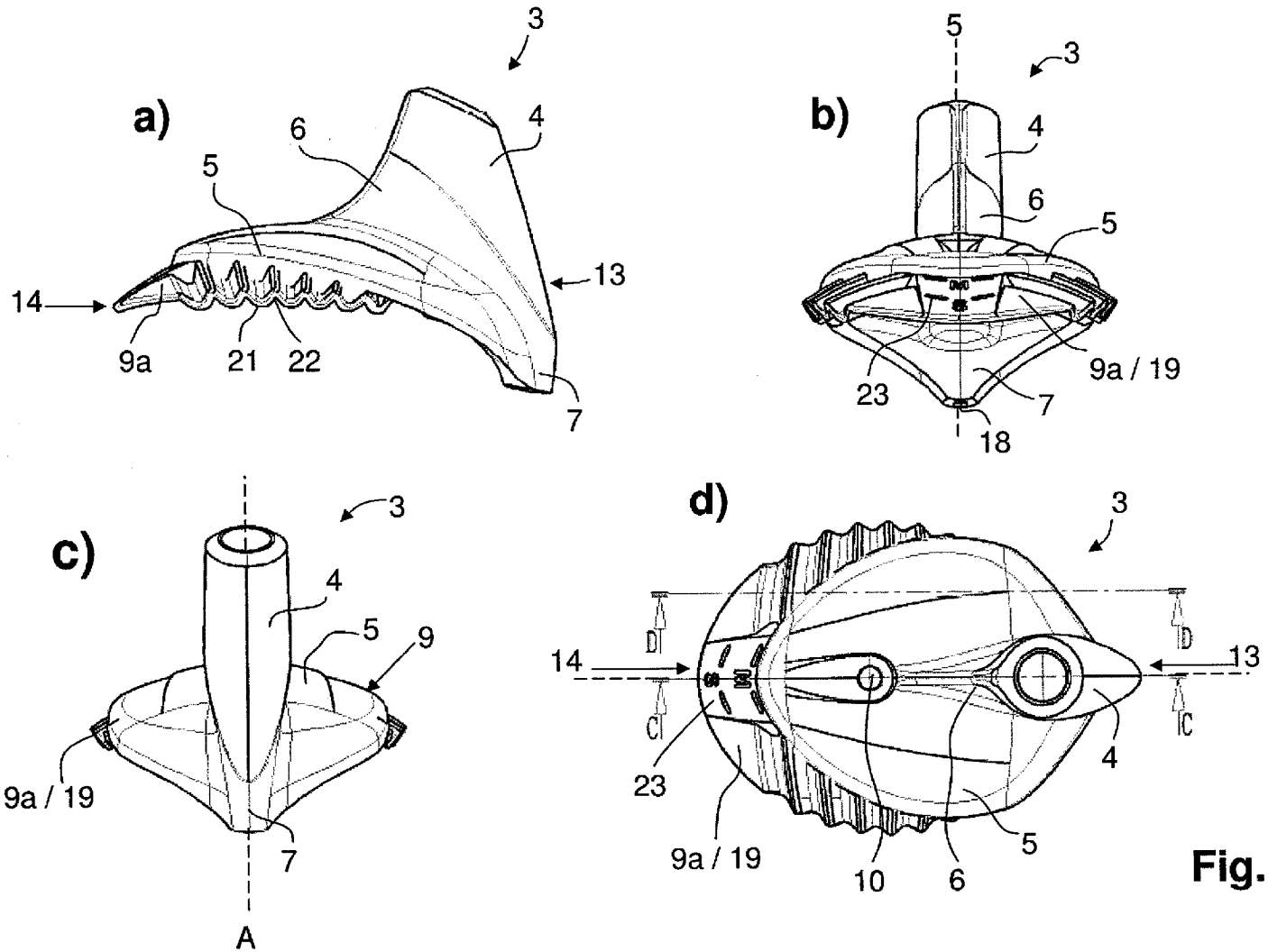
FIG. 4 shows different views of the pole tip according to the embodiment of FIG. 3 for a situation in which the basket plate is mounted in the central of three possible positions, wherein a) illustrates a view from the side, b) illustrates a view from behind, c) illustrates a view from the front, d) illustrates a view from above, e) illustrates a view from beneath, f) illustrates a section along line A-A, g) illustrates a section along line B-B, and h) illustrates, a three-dimensional view.
Figure 4:
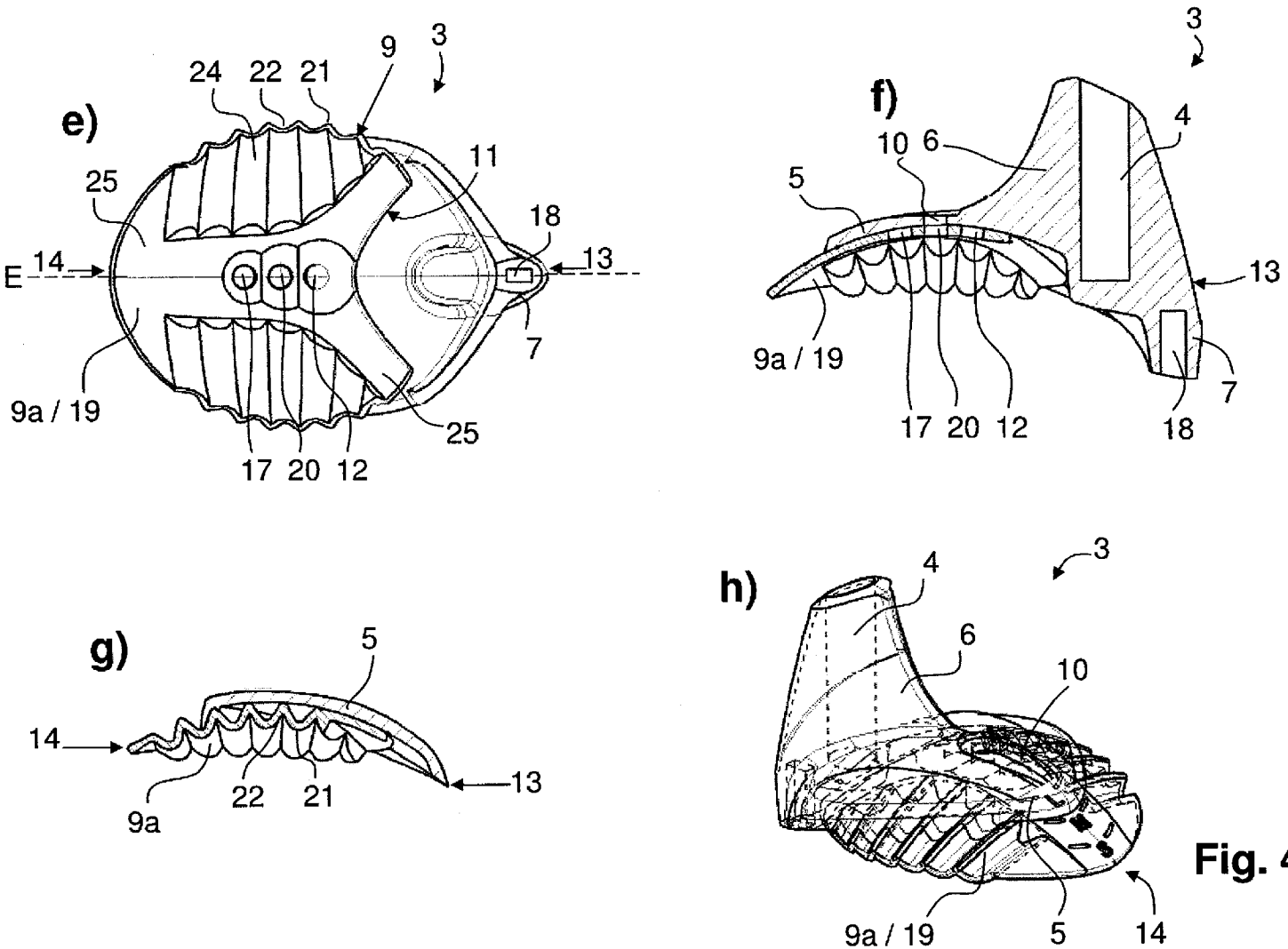
Figure 5:
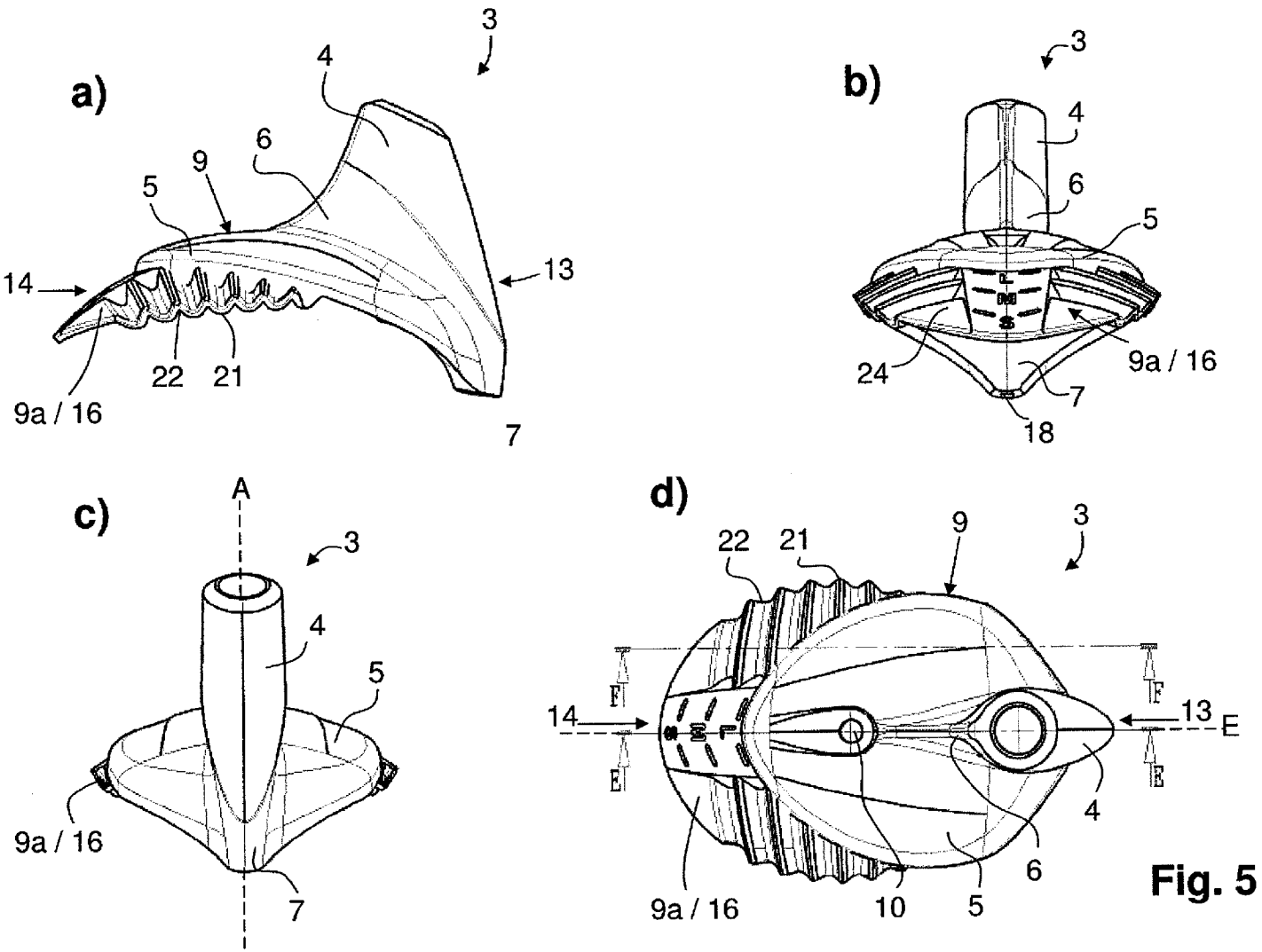
FIG. 5 shows different views of the pole tip according to the embodiment of FIGS. 3 and 4 for a situation in which the basket plate is mounted in the rearmost of three possible positions, wherein a) illustrates a view from the side, b) illustrates a view from behind, c) illustrates a view from the front, d) illustrates a view from above, e) illustrates a view from beneath, f) illustrates a section along line A-A, g) illustrates a section along line B-B, and h) illustrates a three-dimensional view.
Figure 5:
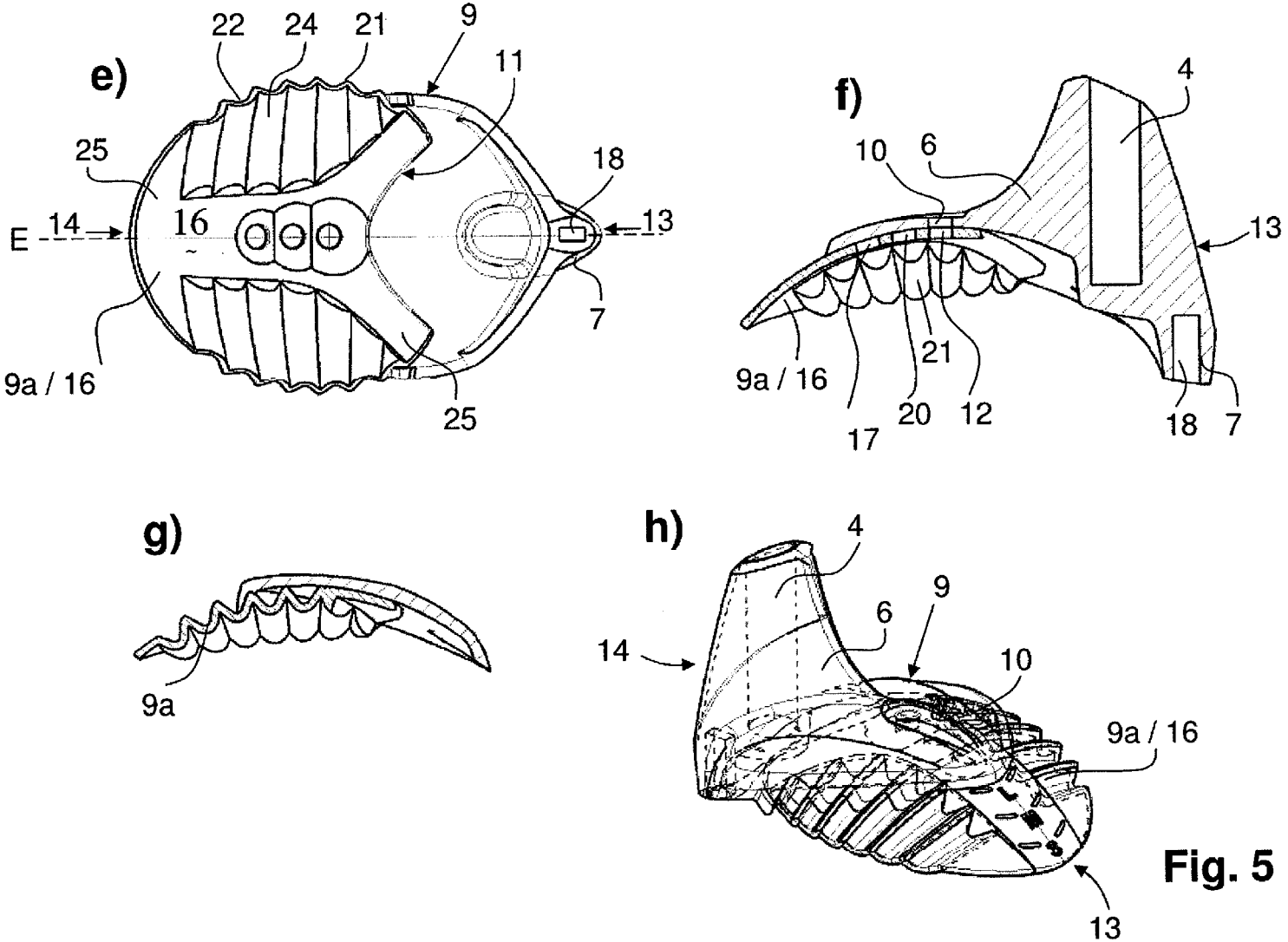

FIGS. 3, 4 and 5 illustrate different views of a second embodiment of the invention. Only the basket attachment, without the pole, is illustrated here in each case. The pole axis A runs virtually through the accommodating region 4. A basket plane E runs essentially perpendicularly thereto. The basket plate 9 or 9*a* illustrated in FIGS. 3-5 is designed in a flexurally rigid and/or hard state from hard plastics material and has essentially the same downwardly concave curvature as the basket region 5.

An adjusting marking 23 is labeled in FIG. 3 by S (small) since in respect of the three possible adjusting positions, as the basket plate 9 is secured by the front hole 12, the basket has the smallest diameter or the smallest surface area. The central adjusting position, which is illustrated in FIG. 4, is labeled on the adjusting-marking region 23 by the letter M (medium) since the adjusting position in the central hole 20 allows an intermediate size of the basket region 5, together with that region of the basket plate 9 or 19 projecting beneath the basket region 5, between the small and the large basket size. FIG. 5 illustrates the rearmost position of the three possible adjusting positions, wherein the rear hole 17 is used for securing purposes. This rear adjusting position is labeled on the adjusting marking 23 by L (large) since the basket plate fixed in the rear position 16 provides the largest of the three basket sizes.

Those lateral edge regions of the basket plate 9 which are illustrated in FIGS. 3-5 have a transversely running continuous or centrally interrupted ribbing formation, comprising ribs 21 and grooves 22, which, upon attachment to the basket region 5, engages in a toothing formation of the basket region 5, this toothing formation likewise comprising corresponding ribs 26 and grooves 27 and being provided in a downwardly projecting edge which runs all the way round at the rear. As a result, despite a single, central hole illustrated in the basket region 5, the basket plate 9 is safeguarded against rotation since the ribbing formation prevents displacement of: the basket plate 9 relative to the basket region 5. In addition, the ribbed side edges provide increased grip on the underlying surface, even with the basket plate removed. The ribbing formation also extends over part of the basket-plate surface area, wherein the proportion of ribbed surface area 24 in relation to the non-ribbed surface area 25 of the basket plate 9 can vary. The adjusting marking 23 is preferably arranged in the rear region of the basket plate, in particular preferably in a central position essentially parallel to the course followed by the stiffening rib 6 and essentially perpendicularly to the pole axis A. In this second embodiment, the hole in the basket region is preferably arranged in the center, particularly preferably in alignment with the stiffening rib 6 and the possibly provided adjusting-marking region 23. The cutout 18 for the spike of the pole tip is clearly visible in FIGS. 3*b,e,f*, 4*b,e,f* and 5*b,e*, and *f*.

LIST OF DESIGNATIONS

1 Pole shaft
2 Ski pole
3 Tip attachment
4 Accommodating region of 3 for 1
5 Basket region
6 Rearwardly directed stiffening rib
7 Extension for accommodating pole tip
8 Pole tip
9 Basket plate
9*a* Stiff basket plate
9*b* Flexible basket plate
10 Fastening screw
10' Top screw
10" Bottom screw
11 Cutout in 9 for 7
12 Front hole in 9
13 Front side
14 Rear side
15 9 in front position
16 9 in rear position
17 Rear hole in 9
18 Cutout in 7 for 8
19 9 in central position
20 Central hole in 9
21 Rib of 9
22 Groove of 9
23 Adjusting marking
24 Ribbed region of 9
25 Rib-free region of 9
26 Rib of 5
27 Groove of 5
A Longitudinal pole axis
E Plane of symmetry

The invention claimed is:

1. An attachment for a pole having a tip attachment which has an upwardly directed accommodating region for a pole shaft, as well as a downwardly directed pole tip and a stiff basket region which extends essentially along a plane perpendicular, or at an angle of between 60-120°, to the axis of the pole shaft, wherein a basket plate is arranged on the basket region such that it can be fastened both in a first position and in at least a second position, which is displaced essentially along the plane of the basket region in relation to the first position, a bearing surface area which is active on the underlying surface being larger in the second position than in the first position.

2. The attachment as claimed in claim 1, wherein the basket plate is arranged on the underside of the basket region.

3. The attachment as claimed in claim 1, wherein the basket region has concave curvature on its underside, and wherein the basket plate is fastened in this curvature from beneath such that the inherently planar basket plate essentially continues the curved shape of the basket region, at least in part, in at least one of the two positions.

4. The attachment as claimed in claim 3, wherein the basket plate is fastened in the curvature from beneath such that the inherently planar basket plate essentially continues the curved shape of the basket region, at least in part, in both positions.

5. The attachment as claimed in claim 1, wherein the basket region is of asymmetrical design, and wherein it essentially does not project toward the front side and the main extent is directed toward the rear side, and wherein the basket region is of circular, elliptical or lenticular design.

6. The attachment as claimed in claim 1, wherein the basket plate has a cutout which is open on one side and is intended for at least one of the pole tip and an extension which carries the pole tip.

7. The attachment as claimed in claim 1, wherein the basket plate consists of a plastics material.

8. The attachment as claimed in claim 7, wherein the basket plate consists of PE, PET, PP, PU, PA or other thermoplastics or mixtures thereof.

9. The attachment, as claimed in claim 7, wherein the plastics material has a thickness ranging from 0.1-0.4 cm.

10. The attachment as claimed in claim 1, wherein the basket region has at least one hole in a region which is offset to the rear in relation to the pole shaft, and wherein the basket plate has at least one front hole, and at least one rear hole, and wherein fastening means are provided to engage through these holes and to fasten the basket plate on the basket region.

11. The attachment as claimed in claim 10, wherein there is at least one of (1) a pair of holes in each case, (2) the screws are screws in which the one screw has an internal thread in the screw shank and the other screw has an external thread on the screw shank, these threads engaging one inside the other in the hole, and (3) wherein a central screw is provided, or a plurality of screws are provided, in conjunction with rotation-prevention means.

12. The attachment as claimed in claim 10, wherein the basket region has two holes in a region which is offset to the rear in relation to the pole shaft.

13. The attachment as claimed in claim 10, wherein the basket plate has a pair of front holes and a pair of rear holes.

14. The attachment as claimed in claim 1, wherein the basket region has just one hole and additionally at least one means for preventing rotation of the basket plate on the basket region, and wherein the number of holes in the basket plate corresponds to the number of adjusting positions of the basket plate on the basket region, wherein the at least one means for preventing rotation of the basket plate on the basket region is a ribbed region or a toothing formation.

15. The attachment as claimed in claim 14, wherein the hole is arranged in the center of the basket region.

16. The attachment as claimed in claim 1, wherein it is possible to fasten basket plates which differ in respect of at least one of size, shape, flexibility and color.

17. The attachment as claimed in claim 1, wherein at least part of the basket plate has transversely running ribs or teeth which are suitable for engaging in a region with mating ribbing.

18. The attachment as claimed in claim 17, wherein at least part of the basket plate has transversely running ribs or teeth which are suitable for engaging in an edge of the basket region.

19. The attachment as claimed in claim 1, wherein the basket plate, in the first position, does not project beyond the basket region at least one of (1) the front edge, which is directed toward the front side, and projects beyond the basket region by between 0.2-1.5 cm laterally and (2) the rear edge, which is directed toward the rear side, and wherein the basket plate, in the second position, has been displaced toward the rear side, so that it projects beyond the basket region by between 1.0-2.5 cm at the rear edge, which is directed toward the rear side.

20. The attachment as claimed in claim 1, wherein the tip attachment consists of hard plastics material and on the top side, at least one essentially vertically running stiffening rib is arranged between the basket region and the accommodating region.

21. The attachment as claimed in claim 1, wherein on at least one of the basket plate and the basket region, at least one securing element is provided, which secures the basket plate in the at least two positions via a force fit or a form fit, it also being possible for the positions to be provided in a stepless manner.

22. The attachment as claimed in claim 21, wherein the securing element is constituted by one selected from the group of snap fasteners, pushbuttons, resilient tongues in combination with one selected from the group of guide means, toothing formations, recesses, latching holes, grooves or combinations thereof.

23. The attachment as claimed in claim 1, wherein the basket plate has an adjusting marking on its rear side.

24. The attachment as claimed in claim 1, wherein a fastening screw arranged in a hole of the basket region is fastened in a rotationally fixed manner in the basket region.

25. The attachment as claimed in claim 1, wherein, for a comparatively hard underlying surface, the basket plate is arranged in the first position, and wherein, for a comparatively soft underlying surface, the basket plate is arranged in the second position whereby the pole is a ski pole and is adapted to different conditions in the underlying surface.

* * * * *